US011713640B2

(12) United States Patent
Guillory et al.

(10) Patent No.: US 11,713,640 B2
(45) Date of Patent: Aug. 1, 2023

(54) SPIRAL BACKUP RING CONTAINMENT FOR PACKER ASSEMBLIES

(71) Applicant: Halliburton Energy Services, Inc., Houston, TX (US)

(72) Inventors: Brett Wayne Guillory, McKinney, TX (US); Muhammad Arra'uf Bin Abdul Shukor, Saudi Arabia (SA)

(73) Assignee: Halliburton Energy Services, Inc., Houston, TX (US)

( * ) Notice: Subject to any disclaimer, the term of this patent is extended or adjusted under 35 U.S.C. 154(b) by 5 days.

(21) Appl. No.: 17/079,192

(22) Filed: Oct. 23, 2020

(65) Prior Publication Data

US 2022/0127925 A1 Apr. 28, 2022

(51) Int. Cl.
*E21B 33/12* (2006.01)
*E21B 23/06* (2006.01)

(52) U.S. Cl.
CPC ..... *E21B 33/1208* (2013.01); *E21B 23/06* (2013.01); *E21B 33/1216* (2013.01)

(58) Field of Classification Search
CPC ... E21B 33/1216; E21B 33/1208; E21B 23/06
See application file for complete search history.

(56) References Cited

U.S. PATENT DOCUMENTS 3,381,969 A * 5/1968 Crow ..... E21B 33/1208 277/340
7,708,080 B2 * 5/2010 Conaway ..... E21B 33/1216 166/387
8,191,625 B2 * 6/2012 Porter ..... E21B 33/1277 166/134
8,910,722 B2 12/2014 Bishop et al.
9,260,936 B1 * 2/2016 Branton ..... E21B 33/1216
10,718,178 B2 * 7/2020 Kellner ..... E21B 33/128
11,066,896 B2 * 7/2021 Heiman ..... E21B 33/1216
2009/0126925 A1 * 5/2009 Guest ..... E21B 33/1216 166/118
2012/0133098 A1 * 5/2012 Farquhar ..... E21B 33/1216 277/336
2013/0192853 A1 8/2013 Themig
(Continued)

FOREIGN PATENT DOCUMENTS

WO 2005-088064 9/2005

OTHER PUBLICATIONS

Halliburton, Completion Solutions, HCT Zoneguard Packers, H012779, 2018.

(Continued)

*Primary Examiner* — Theodore N Yao
(74) *Attorney, Agent, or Firm* — Scott Richardson; C. Tumey Law Group PLLC

(57) ABSTRACT

Systems and methods of the present disclosure generally relate to anti-extrusion techniques for packer assemblies. A packer assembly comprises a mandrel; a retainer movably disposed adjacent to the mandrel, the retainer comprising a ramp; a packer element disposed adjacent to the mandrel and the ramp; a ring movably disposed on the ramp, the ring comprising a spiral cut; and a sleeve disposed around the retainer and the ring, wherein the sleeve is deformable to retain at least the packer element or the ring.

20 Claims, 10 Drawing Sheets

(56) References Cited

U.S. PATENT DOCUMENTS

| | | | | |
|---|---|---|---|---|
| 2013/0306330 | A1* | 11/2013 | Bishop | E21B 33/128 166/387 |
| 2014/0290946 | A1* | 10/2014 | Nguyen | E21B 43/10 166/179 |
| 2016/0053570 | A1 | 2/2016 | Andersen | |
| 2018/0016864 | A1* | 1/2018 | Parekh | E21B 43/26 |
| 2018/0298716 | A1 | 10/2018 | Cayson et al. | |
| 2019/0128089 | A1 | 5/2019 | Guerra et al. | |

OTHER PUBLICATIONS

Halliburton, HCT K2 end rings for swell packers, Openhole Isolation Systems, 2001.

International Search Report and Written Opinion for Application No. PCT/US2020/058023, dated Jul. 8, 2021.

* cited by examiner

SPIRAL BACKUP RING CONTAINMENT FOR PACKER ASSEMBLIES

BACKGROUND

During downhole operations, packer assemblies may be utilized in a wellbore to separate the wellbore into one or more zones. A packer assembly may include a packer element capable of providing an annular seal between a tubing string and a casing string, a slip that can retain the packer assembly in a position by gripping the casing string, a wedge that supports the slip, and a mandrel that provides support to the assembly. Current packer assemblies may not be capable of withstanding high-pressure and high-temperature subterranean conditions.

BRIEF DESCRIPTION OF THE DRAWINGS

These drawings illustrate certain aspects of some examples of the present disclosure and should not be used to limit or define the disclosure.

DETAILED DESCRIPTION

Systems and methods of the present disclosure generally relate to cased or open-hole packer assemblies that may include at least one anti-extrusion sleeve to contain a back-up ring. During expansion of the packer element, the back-up ring may move or rotate along a retainer to contact and deform the sleeve. In particular examples, the back-up ring may include a wedge-shape and a spiral groove or cut pattern. The sleeve may deform to catch or prevent the back-up ring from extruding upon expansion of the packer element. The sleeve may expand and conform to the cased or open hole such that the back-up ring may be contained or squeezed between and in contact with the sleeve, the retainer, and the expanded packer element. In some examples, the sleeve may include at least one layer of elongated segments or petals of malleable metal that may deform and contain the back-up ring upon expansion of the packer element. Particular examples may include a sleeve that may include overlapping petals without any gaps therebetween. In other examples, rather than petals, a sleeve may include a continuous wall.

Figure 1A:
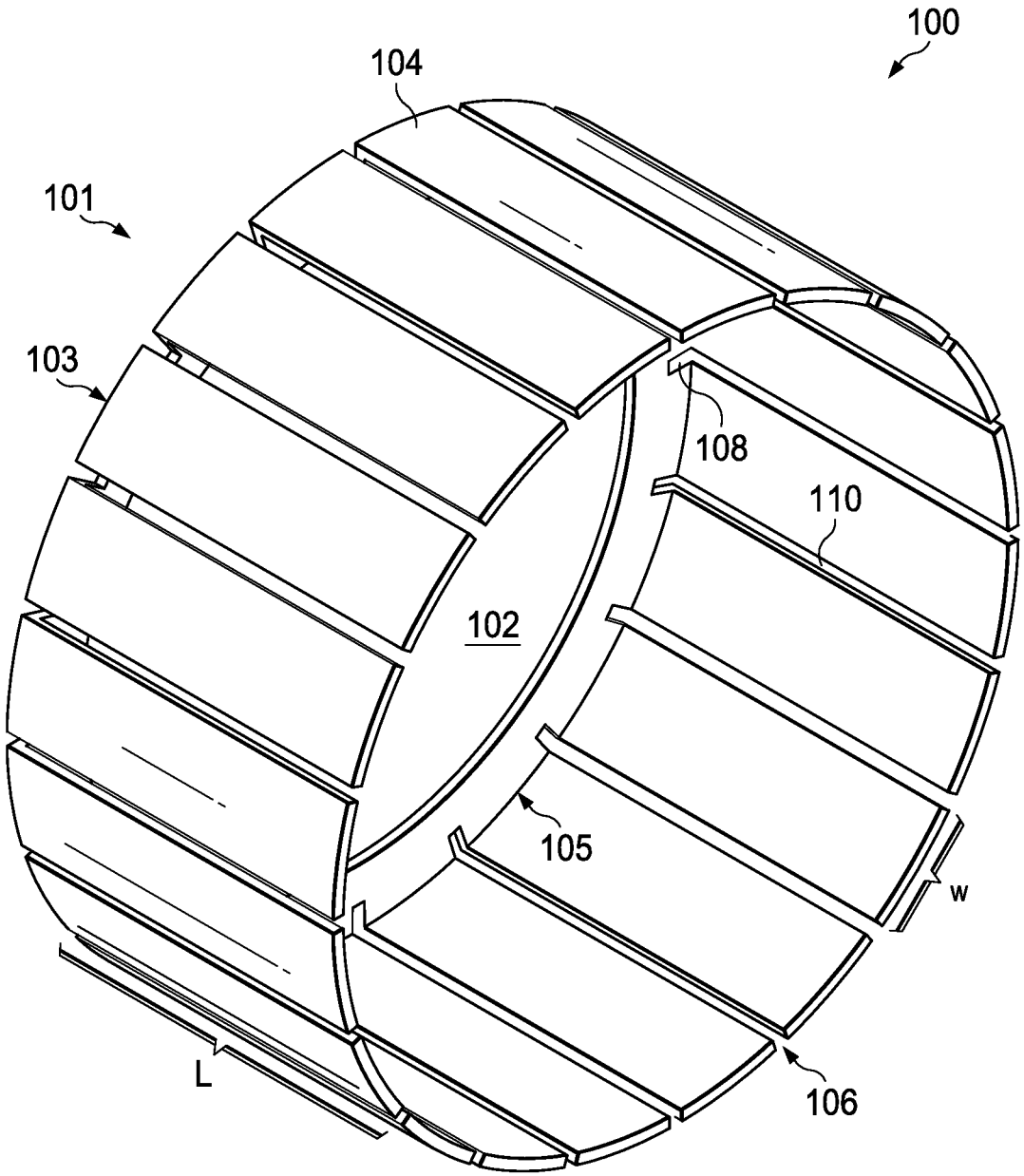
FIG. 1A illustrates an anti-extrusion sleeve with petals, in accordance with examples of the present disclosure.

FIG. 1A illustrates an anti-extrusion sleeve ("sleeve 100"), in accordance with examples of the present disclosure. The sleeve 100 may be made of any suitable material such as metal, plastic, and/or a composite, for example. Non-limiting examples of the metal may include steel, aluminum, brass, nickel, titanium, or combinations thereof. The sleeve 100 may be a single piece of material or may include multiple components fastened together via welds, for example.

In particular examples, the sleeve 100 may be of a hollow cylindrical shape, and include an inner diameter (ID) ranging from 10 centimeters (cm) to 30 cm. A first end 101 of the sleeve 100 may include an opening 102 defined by a base 103 which may be of any suitable shape such as a ring to receive a mandrel, for example.

The sleeve 100 may also include elongated members or petals 104 that may be disposed along a circumference or perimeter of the base 103. The petals 104 may form a portion of the base 103. In some examples, the sleeve 100 may be a single piece of material including bent portions which form the petals 104. The base 103 may be positioned laterally relative to the petals 104 that may extend longitudinally from bends 105 of the sleeve 100. A length, L, of each petal 104 may range from about 5 cm to about 50 cm; a width, w, may range from about 1 cm to about 5 cm; and a thickness may range from about 0.1 cm to about 1 cm. The petals 104 may extend longitudinally from the base 102. Expansion slots ("slots 106") may be disposed between the adjacent petals 104 and may allow for deformation of the petals 104. Each slot 106 may include a lateral portion 108 that extends laterally into a portion of the base 102. The lateral portion 108 may intersect a longitudinal portion 110 of each slot 106. The longitudinal portion 110 of each slot 106 may extend from the lateral portion 108 along a length of each petal 104. In non-limiting examples, a length of each lateral portion 108 may range from about 1 cm to about 5 cm, and a length of each longitudinal portion 110 of each slot 106 may range from about 5 cm to about 50 cm. The width of each of the longitudinal portions 110 and the lateral portions 108 may range from 5 to 10 millimeters (mm) in some examples. The petals 104 of the sleeve 100 may provide for geometric conformance to the irregularities of the cased or open hole.

It should be noted that the sleeve 100 (and components thereof) may be of any suitable shape and/or dimensions depending on a casing diameter, a tool diameter, a size and/or shape of the packer element(s), the retainer(s), and/or the back-up ring(s), among others, as should be understood by one having skill in the art with the benefit of this disclosure.

In particular examples, the sleeve 100 may have a high-diameter expansion ratio ranging from about 110% to about 150%. In non-limiting examples, the sleeve 100 may expand laterally from about 110% to about 150% of its original size. The high expansion ratio may allow a packer element (not shown) to include a slim outer diameter (OD) profile ranging from about 10 centimeters (cm) to about 15 cm. The sleeve 100 may also withstand high pressures ranging from about 10,000 pounds per square inch (psi) to about 15,000 psi. The sleeve 100 may also withstand high temperatures ranging from about 325° F. to about 400° F.

Figure 1B:
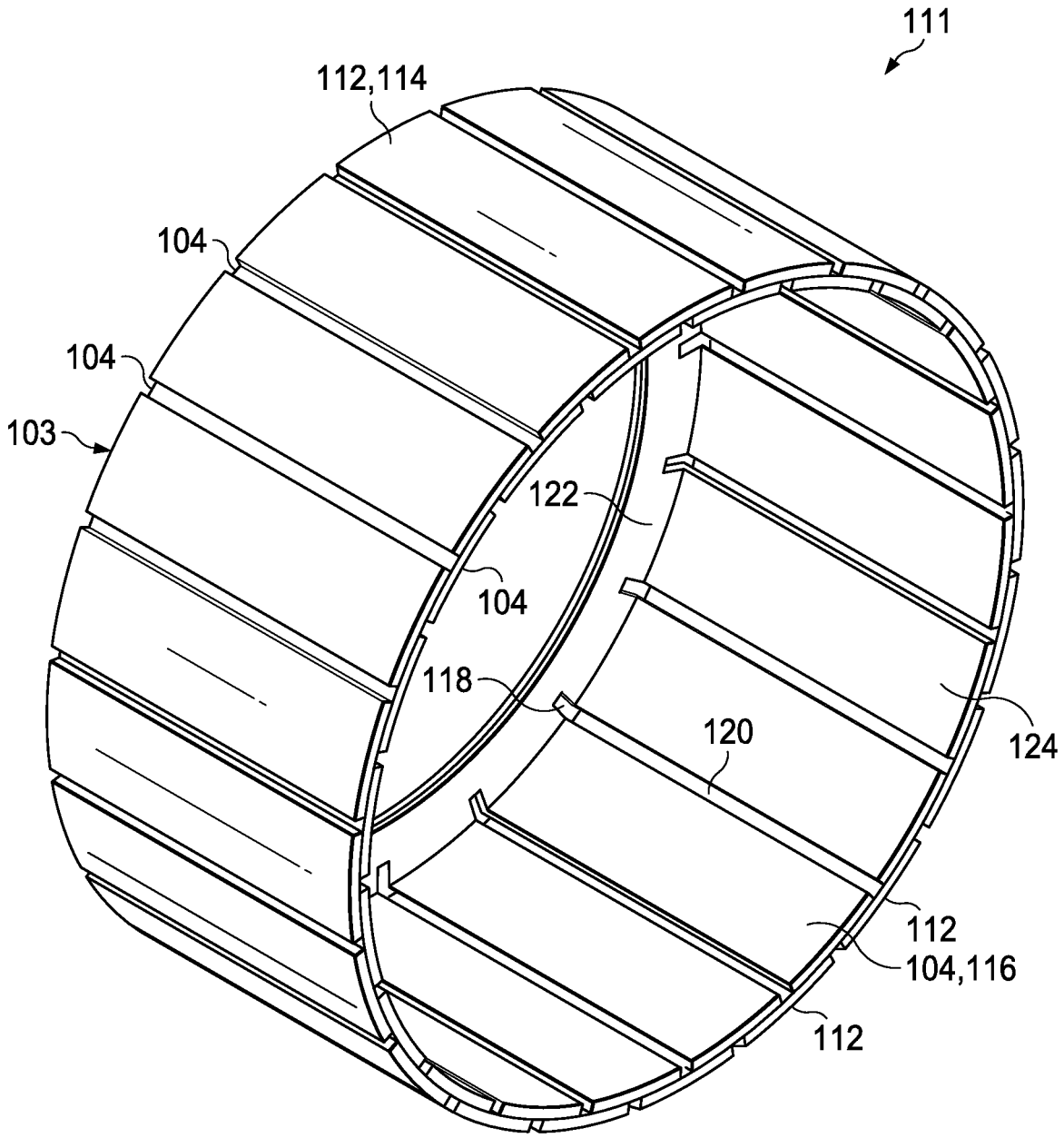
FIG. 1B illustrates an anti-extrusion sleeve with overlapping petals, in accordance with examples of the present disclosure.

FIG. 1B illustrates an anti-extrusion sleeve ("sleeve 111") with overlapping petals 112, in accordance with examples of the present disclosure. Some components of the sleeve 111 may be similar to the sleeve 100 (e.g., shown on FIG. 1A).

As illustrated, the petals 112 may overlap adjacent petals 104 to form ridges that are configured similar to the slots 106 (e.g., shown on FIG. 1A). In some examples, the petals 104 and 112 may be similarly sized. The petals 112 may form ridges 114 along an OD (e.g., an outer row) of the sleeve 100, and the petals 104 may form ridges 116 along an ID (e.g., an inner row) of the sleeve 100. Each of the ridges 114 and 116 include lateral segments and longitudinal segments. For example, each ridge 114 may include a lateral segment 118 that forms a portion of the base 102. Each ridge 114 may also include a longitudinal segment 120 that intersects the lateral segment 118. Similarly, each ridge 116 may include a lateral segment 122 that forms a portion of the base 102. Each ridge 116 may also include a longitudinal segment 124 that intersects the lateral segment 118. Additionally, there may not be gaps, slots, or spaces between the petals 104 and 112. The petals 112 may provide for additional support to the back-up ring and act as a debris barrier by closing the slots 106 (e.g., shown on FIG. 1A).

Figure 1C:
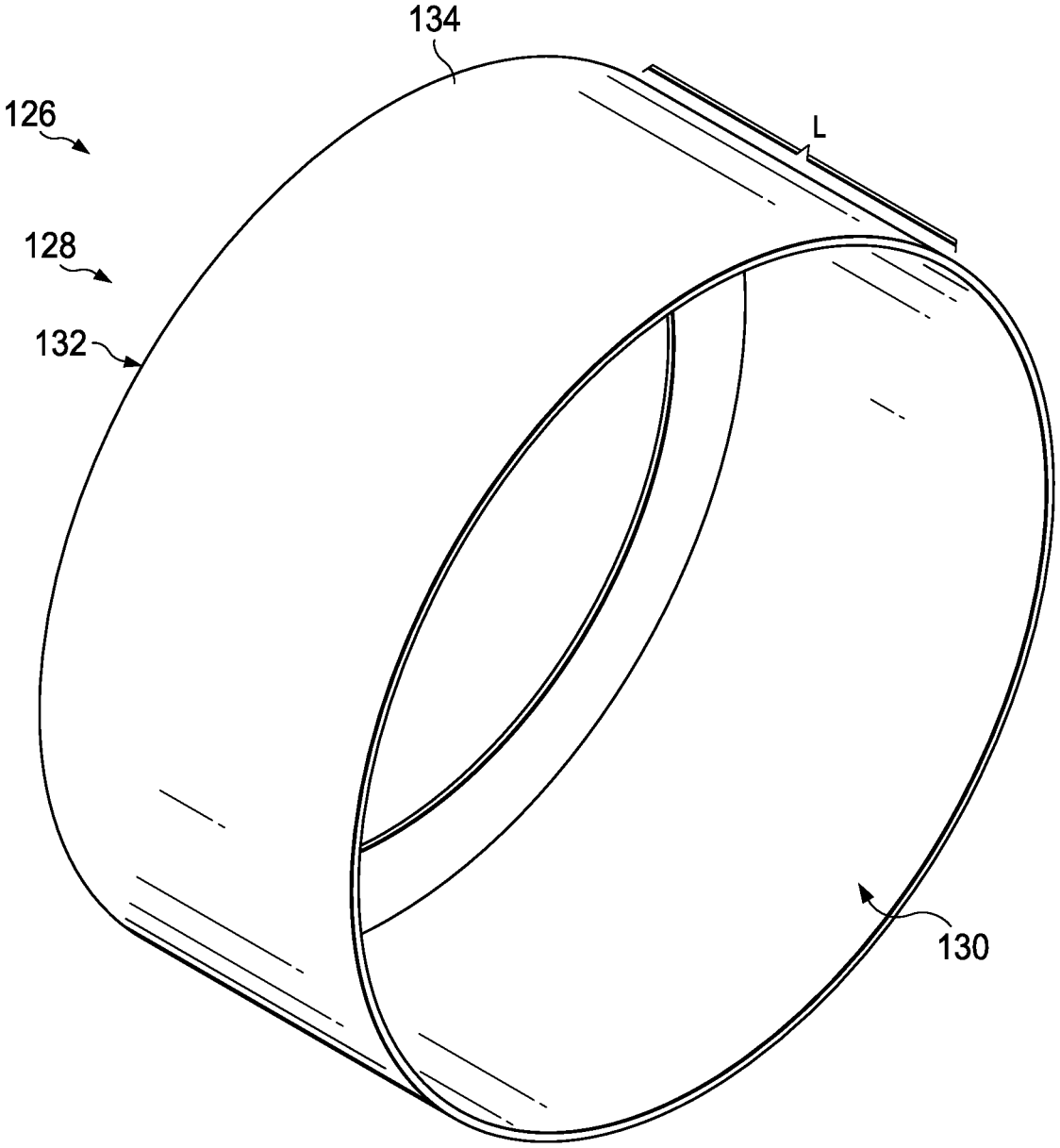
FIG. 1C illustrates an anti-extrusion sleeve with a continuous wall, in accordance with examples of the present disclosure.

FIG. 1C illustrates an anti-extrusion sleeve ("sleeve 126") which may be a single piece made of metal, in accordance with examples of the present disclosure. Non-limiting examples of the metal may include steel, aluminum, brass, nickel, titanium, or combinations thereof. In particular examples, the sleeve 126 may be of a hollow cylindrical shape, and include an ID ranging from about 10 cm to about 12 cm.

A first end 128 of the sleeve 126 may include an opening 130 defined by a base 132 which may be of any suitable shape such as a ring, for example. The sleeve 126 may also include a wall 134 that may be disposed along a circumference or perimeter of the base 102 to form a hollow cylinder, as illustrated. In some examples, the wall 134 may be a smooth and continuous surface with a length, L, ranging from about 5 cm to about 20 cm; and a thickness ranging from about 0.1 cm to about 0.5 cm. The wall 134 may provide for a continuous circumferential external surface that reduces the chance of the packer assembly 200 being caught by any ID (cased or open hole) restriction downhole.

Figure 2A:
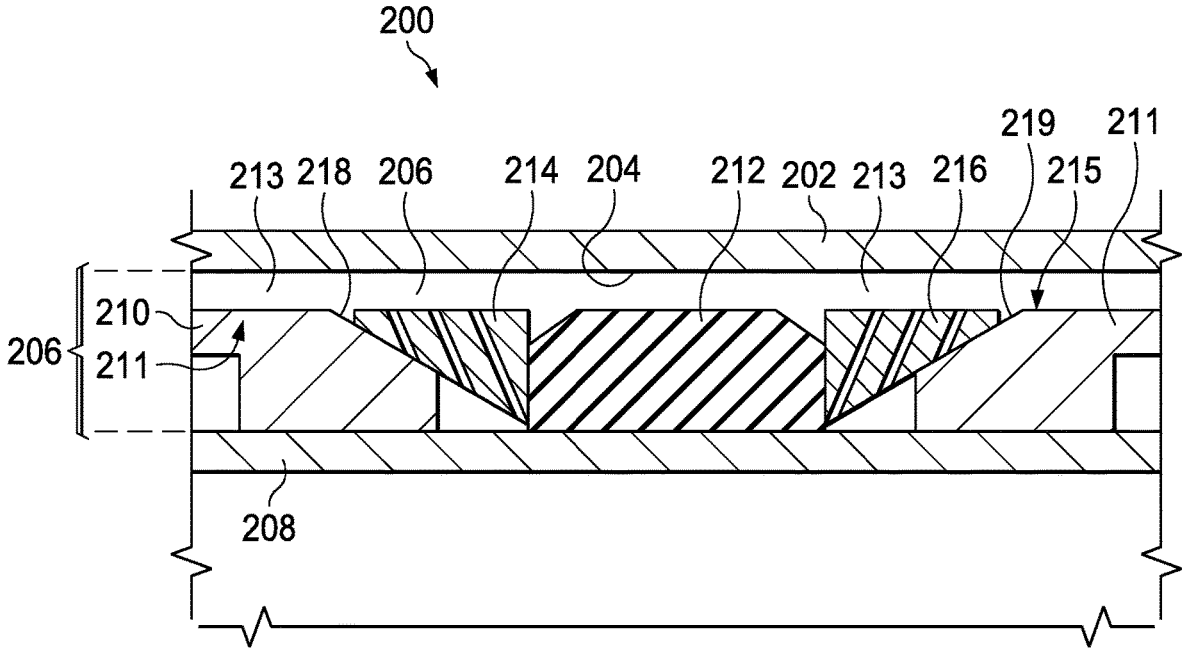
FIG. 2A illustrates a cross-sectional view of packer assembly in an unexpanded or run-in condition, in accordance with examples of the present disclosure.

FIG. 2A illustrates a cross-sectional view of packer assembly 200 in an unset or run-in condition, in accordance with examples of the present disclosure. The packer assembly 200 may be disposed in casing 202 (or open hole) that includes an inner surface 204. An annulus 206 may be defined between the casing 202 and a mandrel 208 (e.g., a packer tool body). Retainers 210 and 211 may be members that may be positioned to expand a packer element 212 as the retainers 210 and 211 are drawn towards each other upon actuation or setting of the packer assembly 200. Actuation or setting of the packer assembly may occur by any suitable technique, as should be understood by one having skill in the art with the benefit of this disclosure. The retainers 210 and 211 may slidably engage the mandrel 208, for example. Back-up rings 214 and 216 may be disposed between the retainers 210 and 211 and the packer element 212. The back-up rings 214 and 216 may expand along conical surfaces or ramps 218 and 219 of the retainers 210 and 211. The back-up rings 214 and 216 may retain the packer element 212; retain sealing pressure inside the packer element 212; and/or prevent extrusion of the packer element 212 by creating a labyrinth seal, in some examples. As the packer element 212 is expanded outward toward the casing inner surface 204, the back-up rings 214 and 216 may move (e.g., slide) along the ramps 218 and 219 of the retainers 210 and 211 on both sides of the packer element 212, thereby assisting with reducing or preventing extrusion of a sealing component (e.g., the back-up rings 214, 216, the packer element 212) into the annulus 206. The ramps 218 and 219 may be slanted toward the packer element 212 which may be disposed between the ramps 218 and 219. Gaps 213 may receive a portion of each of the back-up rings 214 and 216 upon expansion of the packer element 212. The gaps 213 may be disposed between the retainer 210 (e.g., a portion 211 of the retainer 210 that is adjacent to the ramp 218) and the inner surface 204 of the casing 202, and between the retainer 216 (e.g., a portion 215 of the retainer 211 that is adjacent to the ramp 219) and the inner surface 204 of the casing 202. In some examples, the portions 211 and 215 may extend longitudinally from the ramps 218 and 219.

The angle of the ramps 218 and 219 may be any angle that may accept the corresponding conical shaped face of the back-up rings 214 or 216 and allow the back-up rings 214 and 216 to move along the ramps 218 and 219 as the packer element 212 is expanded. In some examples, the angle may range from about 5° to about 60°. In another example, the angle may range from about 20° to about 35°.

In some examples, the packer assembly 200 may include a plug (not shown) connected within the mandrel 208 by matching threads, pins, welding, or any other suitable means, and said assembly may be referred to as a bridge plug. The plug may include a seal located between the plug and an internal diameter of the mandrel 208 to prevent fluid flow therebetween. Packer assemblies typically may include at least one means for allowing fluid communication therethrough. Fluid flow may be controlled by one or more valve mechanisms that may be integral to a packer tool body or which may be externally attached to the packer tool body.

Figure 2B:
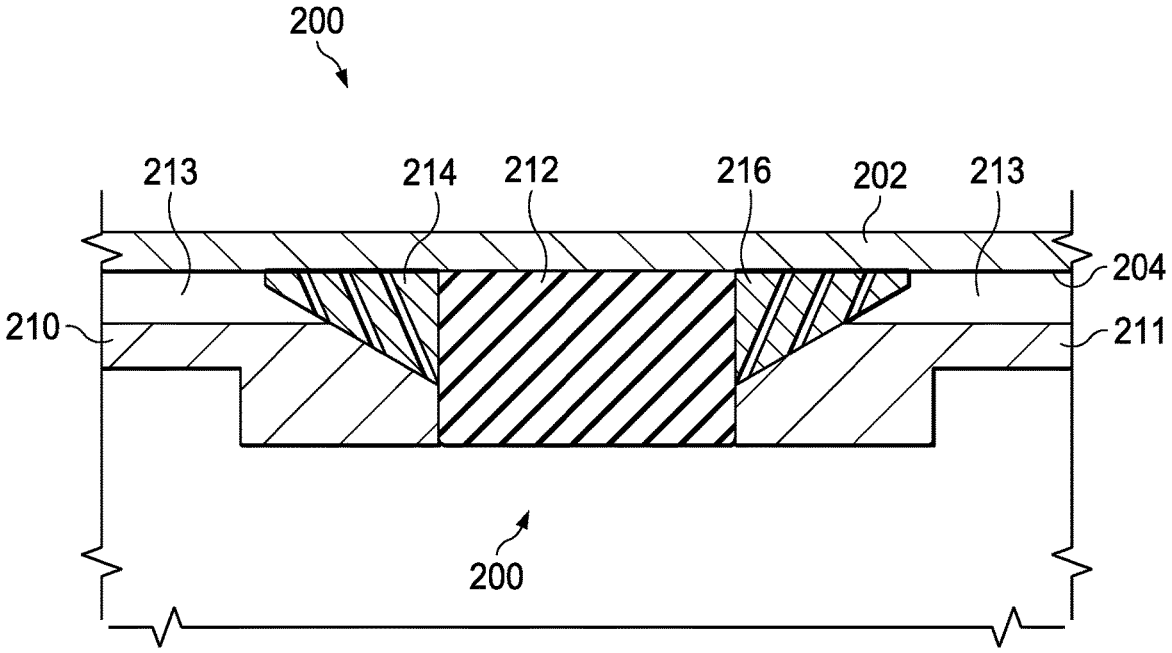
FIG. 2B illustrates a cross-sectional close-up view of the packer assembly in an expanded or actuated state, in accordance with examples of the present disclosure.

FIG. 2B illustrates a cross-sectional close-up view of the packer assembly 200 in a set condition, in accordance with examples of the present disclosure. As illustrated, the packer element 212 may expand outward to contact and seal against the inner surface 204 of the casing 202, and the back-up rings 214 and 216 have moved along the ramps 218 and 219 of the retainers 210 and 211 such that at least a portion of each back up-ring 214 and 216 may be disposed in the gaps 213.

Figure 3A:
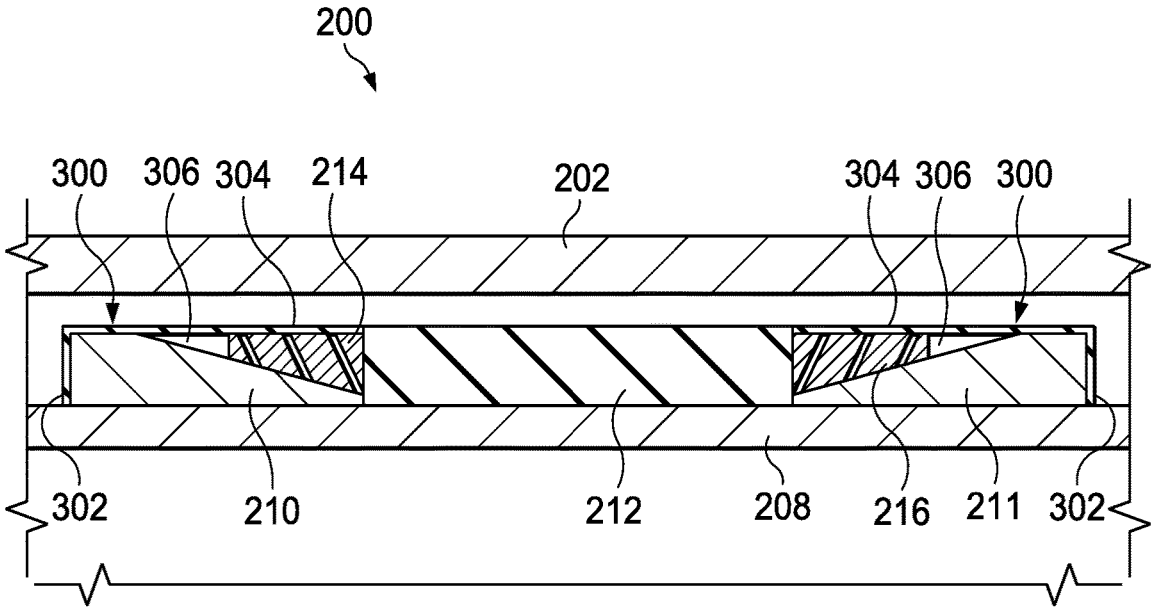
FIG. 3A illustrates a cross-sectional view of the packer assembly with anti-extrusion sleeves, in an unexpanded or run-in condition, in accordance with examples of the present disclosure.

FIG. 3A illustrates a cross-sectional view of the packer assembly 200 with anti-extrusion sleeves ("sleeves 300"), in an unset or run-in condition, in accordance with examples of the present disclosure. The sleeves 300 may be similar to any of the previously described sleeves 100, 111, and/or 126 (e.g., shown on FIGS. 1A-1C). A first sleeve 300 may be disposed around the retainer 210 and the back-up ring 214. A second sleeve 300 may be disposed around the retainer 211 and the back-up ring 216. In some examples, the mandrel 208 may extend through the sleeve 300. The sleeves 300 may be welded in place (e.g., to the retainers 210 and 211) or bolted to the retainers 210 and 211 and/or the back-up rings 214 and 216. Alternatively, rubber may be molded over components of the packer assembly 200 to secure the components.

The mandrel 208 may extend through the sleeves 300. The base 302 of each sleeve 300 may be disposed on an up-hole end or a downhole end of each of the retainers 210 and 211 such that bases 302 extend laterally from the mandrel 208, whereas, longitudinal portions 304 of the sleeves 300 may extend longitudinally over the back-up rings 214 and 216 to form empty spaces 306 bound by each of the retainers 210 and 211, the sleeves 300, and the back-up rings 214 and 216. The spaces 306 may receive tapered portions of the back-up rings 214 and 216 upon expansion of the packer element 212. The longitudinal portions 304 may include the petals 104, the petals 112, and/or the wall 134 as shown on FIGS. 1A-1C, for example.

As noted previously, the packer assembly 200 may be disposed in the casing 202 (or open hole). An annulus 206 may be defined between the casing 202 and a mandrel 208 (e.g., a packer tool body). Depending on placement in a wellbore, the back-up ring 214 or 216 may move up-hole or downhole to deform the corresponding sleeve 300. The packer element 212 may be disposed between the back-up rings 214 and 216.

Figure 3B:
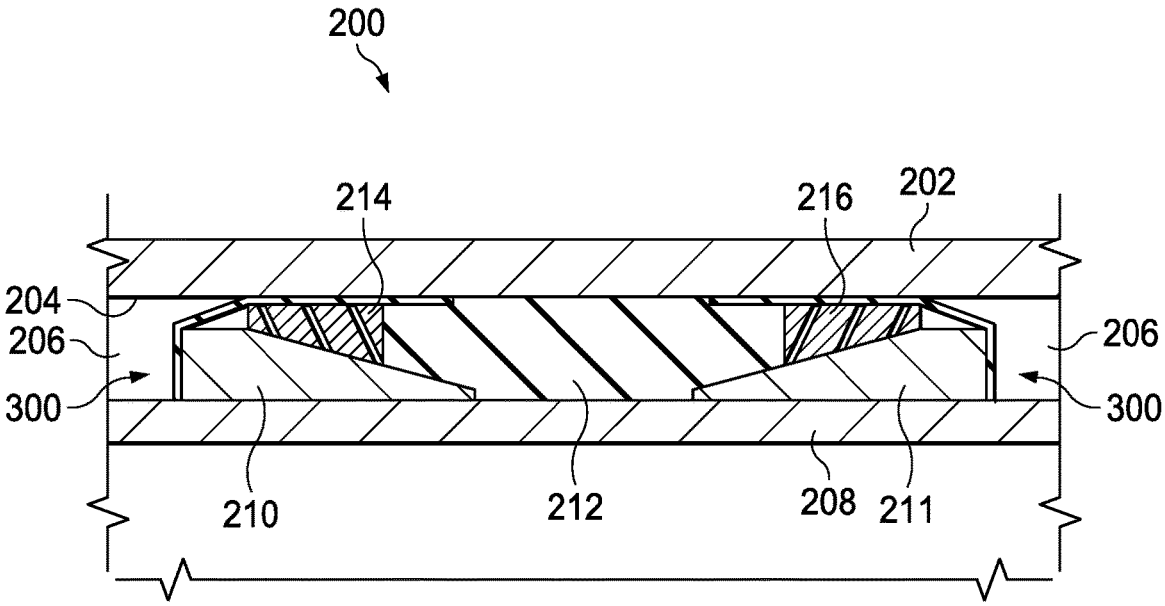
FIG. 3B illustrates a cross-sectional view of the packer assembly with anti-extrusion sleeves, in an expanded or actuated state, in accordance with examples of the present disclosure.

FIG. 3B illustrates a cross-sectional view of the packer assembly 200 with anti-extrusion sleeves ("sleeves 300") in a set condition, in accordance with examples of the present disclosure. The retainers 210 and 211 may be drawn towards each other to expand the packer element 212. The back-up rings 214 and 216 may move along the ramps 218 and 219 of the retainers 210 and 211 to deform the sleeves 300. The sleeves 300 may conform to the inner surface 204 of the casing 202 and prevent the back-up rings 214 and 216 from extruding into the annulus 206, thereby assisting with reducing or preventing the migration of sealing material (e.g., the packer element 212).

Figure 4A:
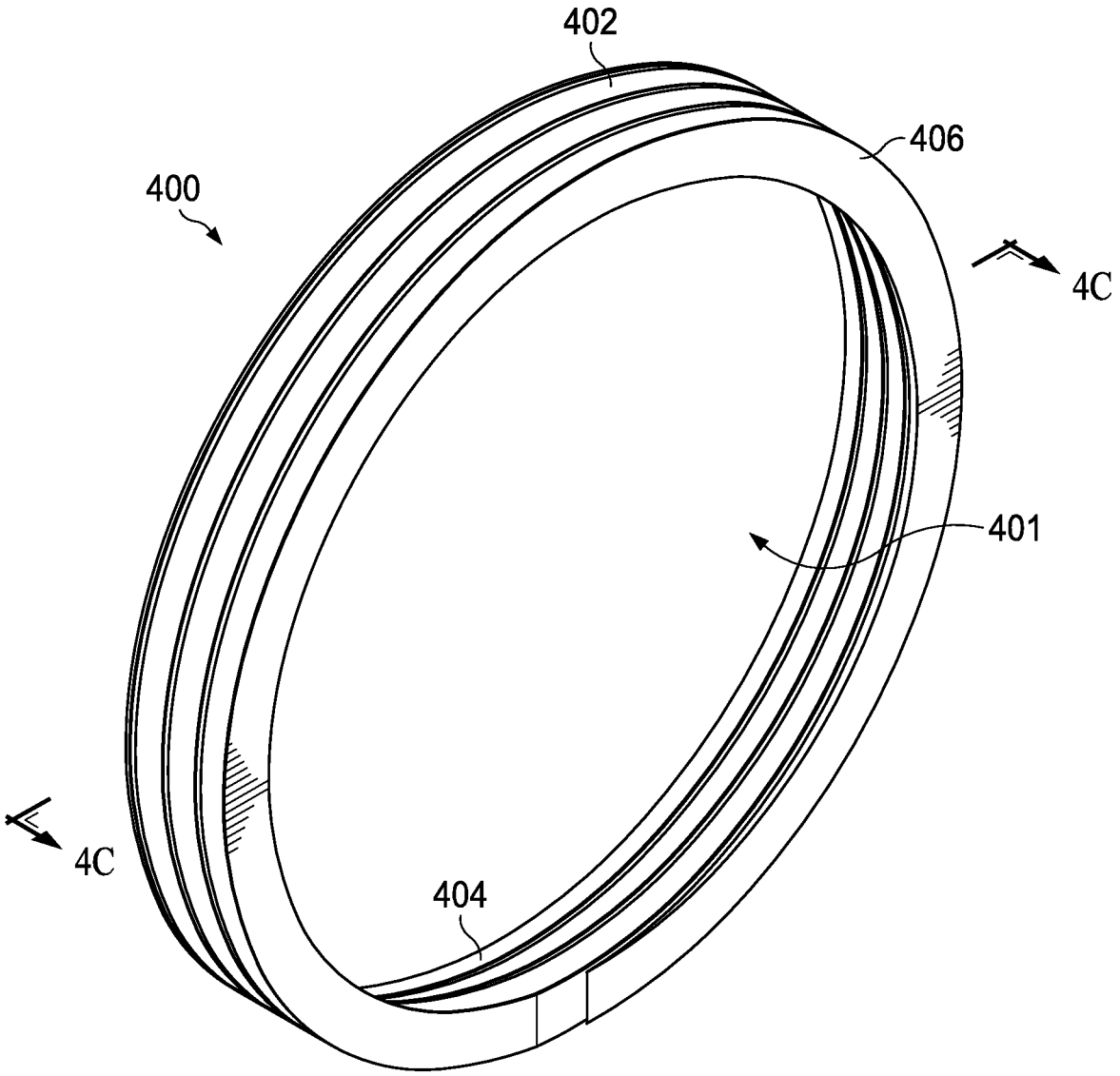
FIG. 4A illustrates a perspective view of a back-up ring, in accordance with examples of the present disclosure.
Figure 4B:
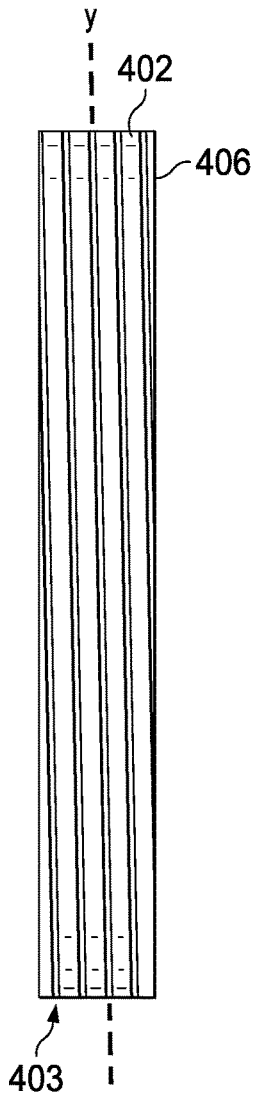
FIG. 4B illustrates an outer circumferential face of the back-up ring, in accordance with examples of the present disclosure.
Figure 4C:
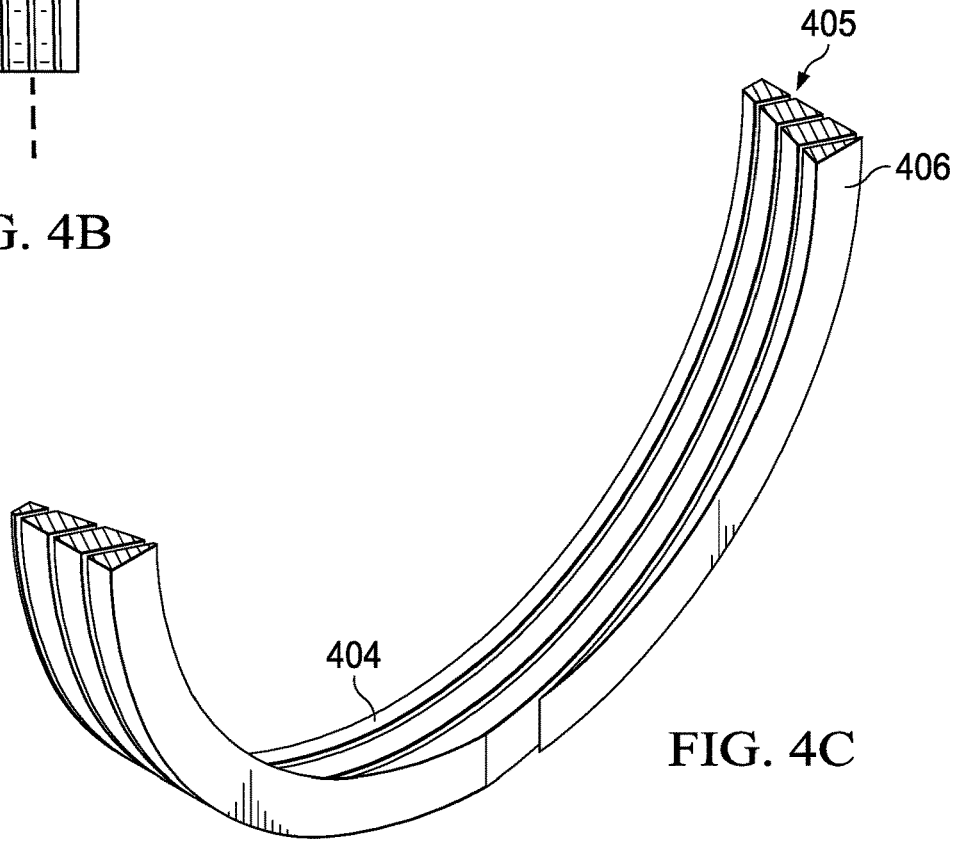
FIG. 4C illustrates an inner circumferential face of the back-up ring, in accordance with examples of the present disclosure.

FIGS. 4A-4C depict a back-up ring 400, in accordance with examples of the present disclosure. The back-up ring 400 may include the back-up ring 214 or 216, for example. As shown on FIG. 4A, a basic construction of the back-up ring 400 may be a wedge (or include a tapered portion) with a continuous spiral cut. The back-up ring 400 may include at least one outer circumferential face 402, at least one conical, inner circumferential face 404, and an axial end face 406.

As shown on FIG. 4B, the outer circumferential face 402 may be configured to contact a wellbore casing (e.g., the casing 202 shown on FIG. 2A) or liner. The outer circumferential face 402 may include a spiral cut 403. The spiral cut 403 may range from about 0° to about 20° from a vertical axis y.

As shown on FIG. 4C, the conical, inner circumferential face 404 may contact at least a portion of a retainer (e.g., the retainers 210 and 211 shown on FIGS. 3A and 3B). The conical, inner circumferential face 404 may include a spiral cut 405 which may be angled similarly to the spiral cut 403. Further, the axial end face 406 may be configured to contact a packing element (e.g., the packer element 212 shown on FIGS. 3A and 3B). An angle of the conical, inner circumferential face 402 may be any angle that allows sliding of the back-up ring 400 along the corresponding ramp 218 or ramp 219 of the retainer 210 or the retainer 211 (e.g., shown on FIGS. 3A and 3B). In some examples, the angle may range from about 5° to about 60°.

The back-up ring 400 may unwind as it moves up the conical face of the retainer 210 or 211. Ends of the spiral shape may turn and the outer circumferential face 402 increases in diameter as the back-up ring 400 slides up the ramp 218 or the ramp 219 (e.g., shown on FIGS. 3A and 3B). The spiral ring shape acts as a spring as it expands up the ramps 218 and 219 of the retainers 210 and 211. The spring force may pull the expanded back-up ring 400 back down to the ramps 218 and 219 which may aid in retrieval because the back-up ring 400 should return to, or nearly to, the run-in condition or shape, for retrieval.

Additionally, the spring force may also push on the packer element 212 (e.g., shown on FIGS. 3A and 3B) to keep the packer element 212 energized. The packer element 212 may be less likely to lose pressure with the additional spring force provided by the back-up ring 400. Further, the spiral cuts 403 and 405 may close after the back-up ring 400 is pushed up the ramps 218 and 219, thereby forming a labyrinth seal preventing packer element extrusion.

The back-up ring 400 may be made of any material strong enough to retain the expanded packer element 212 under downhole conditions. In an example, the back-up ring 400 may start as a metal wedge made from annealed stainless steel. The wedge may be spiral cut with electrical discharge machining (EDM) or conventional milling.

Figure 4D:
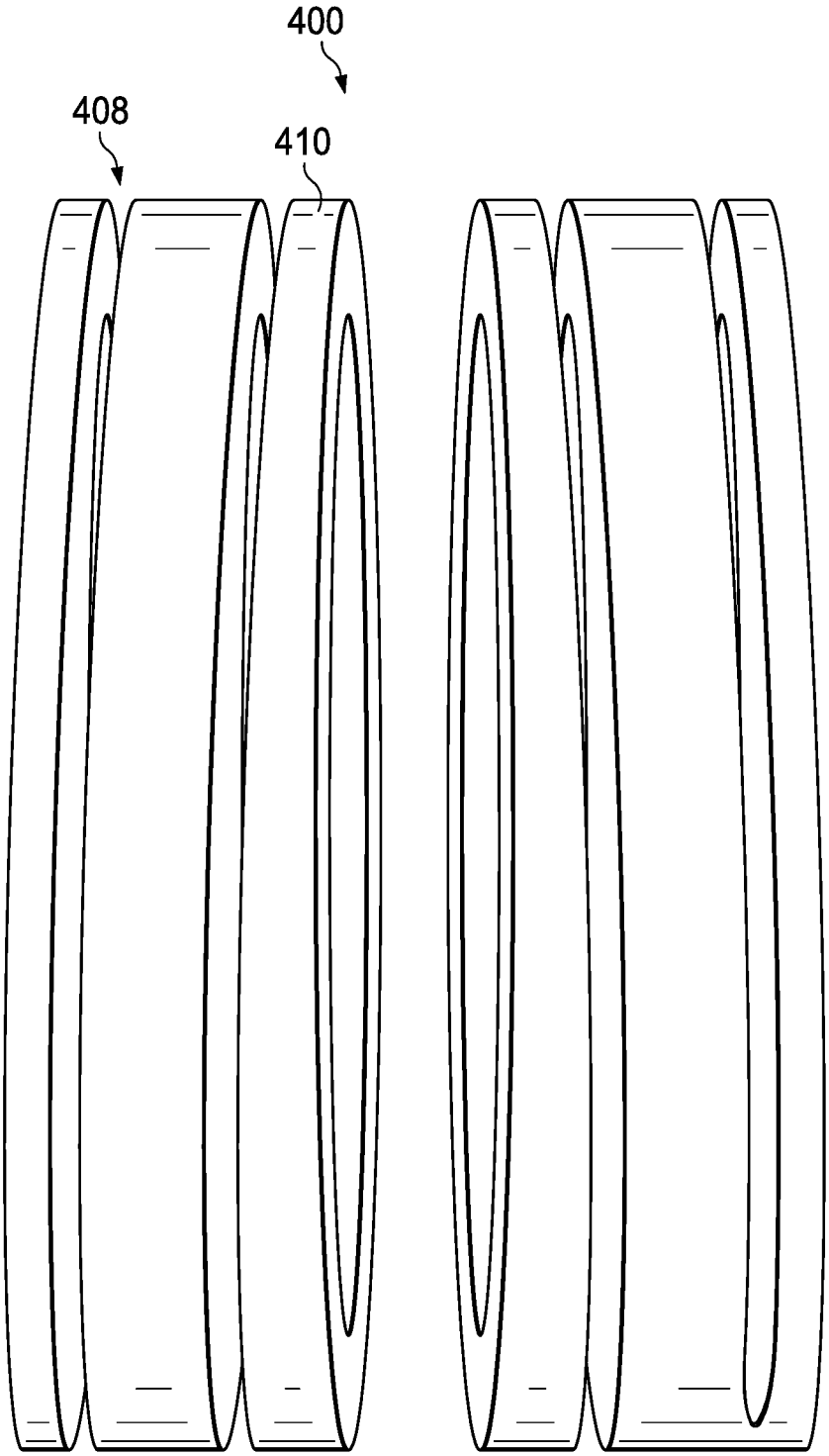
FIG. 4D illustrates the back-up ring created via conventional machining or milling, in accordance with examples of the present disclosure.

FIG. 4D illustrates the back-up ring 400 created via conventional machining or milling, in accordance with examples of the present disclosure. In particular examples, conventional milling may only be used for spiral cuts 408 that are angled 90° to the OD surface 410 of the back-up ring 400. Conventional machining may provide for fast and cost-effective manufacturing. In some examples, the back-up ring 400 may be an investment casting. In another example, the back-up ring 400 may be 3-D printed.

Figure 4E:
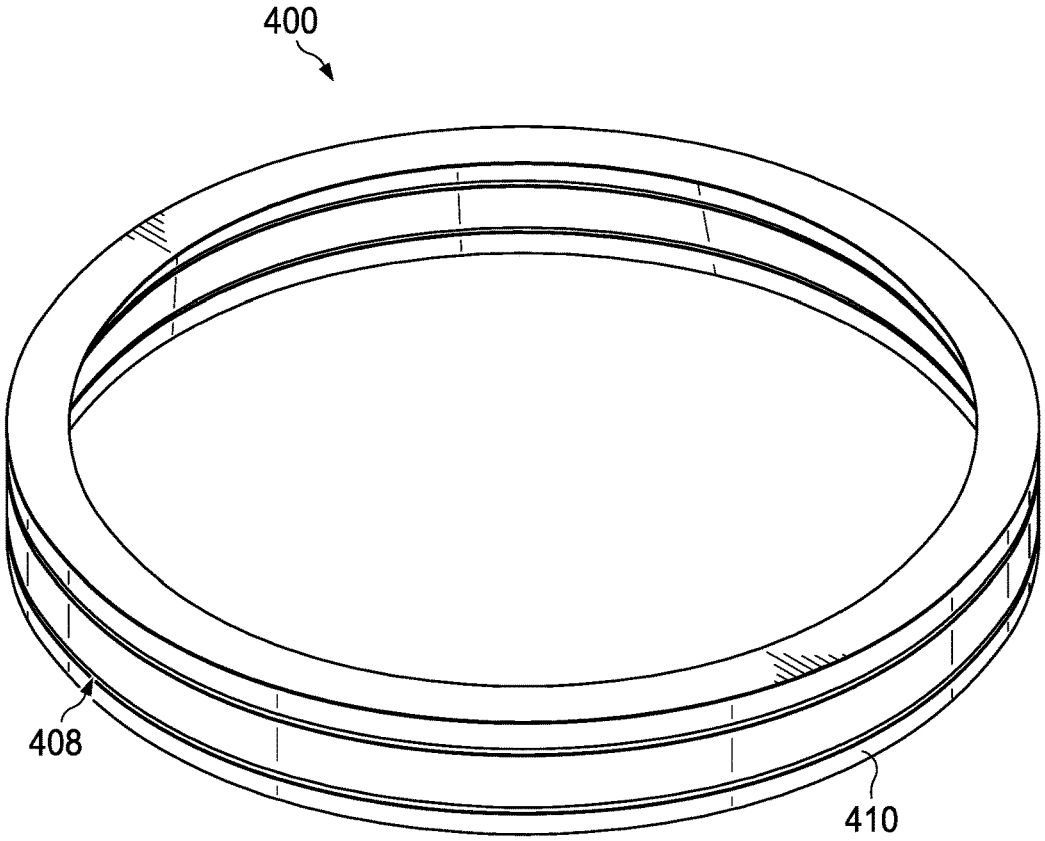
FIG. 4E illustrates a top perspective view of the back-up ring which has been 3-D printed, in accordance with examples of the present disclosure.

FIG. 4E illustrates a top perspective view of the back-up ring 400 which has been 3-D printed, in accordance with examples of the present disclosure. In some examples, the back-up ring 400 may include spiral cuts 408 that may be angled at any suitable angle ranging from 0° to 180° from the OD surface 410 of the back-up ring 400.

Figure 4F:
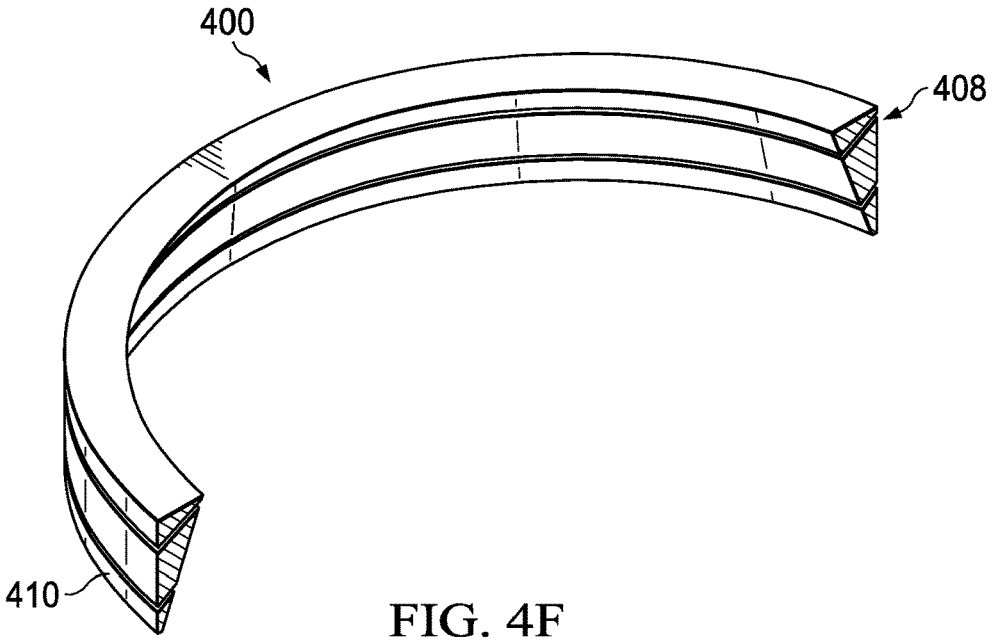
FIG. 4F illustrates a cross-sectional view of the 3-D printed back-up ring, in accordance with examples of the present disclosure.

FIG. 4F illustrates a cross-sectional view of the back-up ring 400 which has been 3-D printed, in accordance with examples of the present disclosure. As illustrated, the spiral cuts 408 are not limited to 90° and can be greater or less than 90°, in contrast to conventional milling, for example. 3-D printing may provide for manufacturing of non-metallic back-up rings using non-metallic powders or filaments. One of skill in the art should realize with the benefit of this disclosure, that the back-up ring 400 has many functions, including, for example, expanding out to contact casing, possessing high expansion properties that retain packing elements, retrievability because the back-up ring spring force may return the back-up ring to the run-in shape, and forming a labyrinth seal to prevent packer element extrusion.

Figure 5:
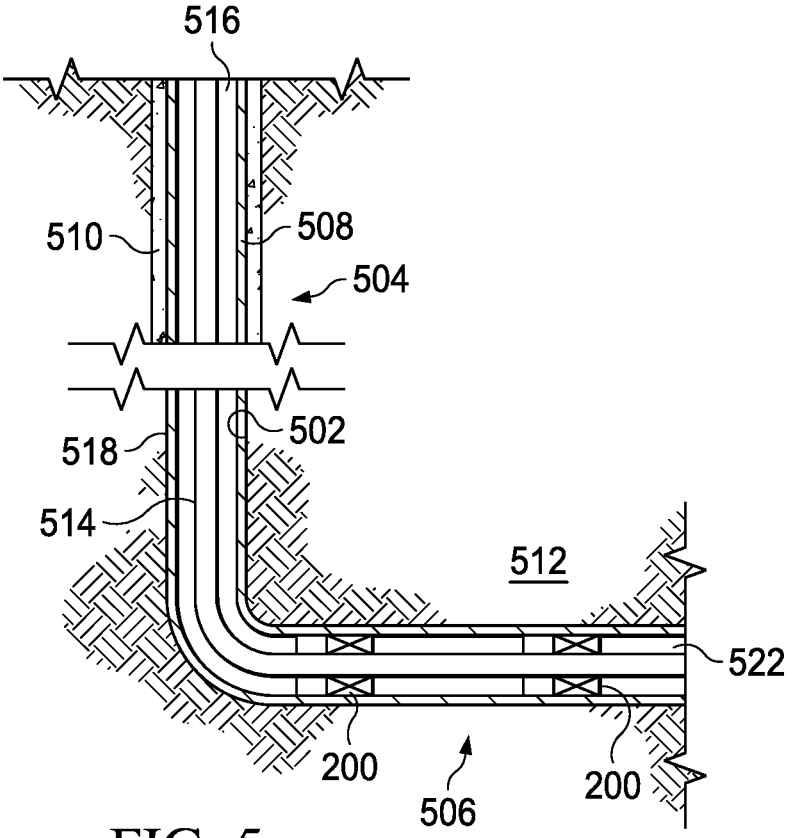
FIG. 5 illustrates a well system with packer assemblies, in accordance with examples of the present disclosure.

FIG. 5 illustrates a well system 500 with packer assemblies 200, in accordance with examples of the present disclosure. The well system 500 may include a wellbore 502 extending through various earth strata. The wellbore 502 may have a substantially vertical section 504 and a substantially horizontal section 506. The substantially vertical section 504 and the substantially horizontal section 506 may include a casing string 508 cemented in place with cement 510. The substantially horizontal section 506 may extend through a hydrocarbon bearing subterranean formation 512.

A tubing string 514 may extend into the wellbore 502. An annulus 516 may be disposed between the tubing string 514 and a wall 518 of the wellbore 502. The tubing string 514 may provide a conduit for formation fluids to travel from the substantially horizontal section 506 up-hole. The packer assemblies 200 including the sleeves 300 (e.g., shown on FIGS. 3A and 3B) may be positioned with the tubing string 514 in the horizontal section 506. The packer assemblies 200 may provide annular seals between the tubing string 514 and the casing string 508 to define zones 520 and 522. The packer assemblies 200 may provide desired load performance and may be retrievable from the wellbore 502. Although FIG. 5 depicts packer assemblies 200 positioned in the substantially horizontal section 506, the packer assemblies 200 may be located, additionally or alternatively, in the substantially vertical section 504. Furthermore, any number of packer assemblies 200 may be used. In some examples, packer assemblies 200 may be disposed in wellbores including only a substantially vertical section.

Figure 6:
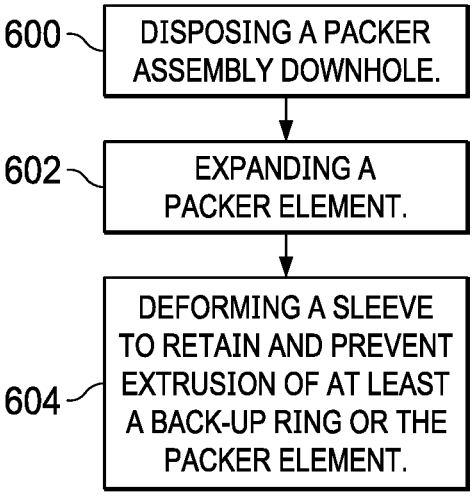
FIG. 6 illustrates an anti-extrusion operative sequence for retaining the back-up ring during expansion of a packer element, in accordance with examples of the present disclosure.

FIG. 6 illustrates an anti-extrusion operative sequence for retaining a back-up ring during expansion of a packer element, in accordance with examples of the present disclosure. At step 600, the packer assembly 200 (e.g., shown on FIGS. 3A and 3B) may be disposed downhole. At step 602, the retainers 210 and 211 (e.g., shown on FIGS. 3A and 3B) may move (e.g., slide) along the mandrel 208 to expand the packer element 212 (e.g., shown on FIGS. 3A and 3B) and drive the back-up rings 214 and 216 onto the ramps 218 and 219 (e.g., shown on FIGS. 3A and 3B) and into the sleeves 300 (e.g., shown on FIGS. 3A and 3B). At step 604, the sleeves 300 catch the back-up rings 214 and 216, and deform to retain the back-up rings 214 and 216 and prevent the back-up rings 214 and 216 and/or the packer element 212 from extruding into the annulus 206 (e.g., shown on FIG. 2A).

Accordingly, the systems and methods of the present disclosure utilize a deformable sleeve to prevent extrusion of packer assembly components upon setting of a packer assembly.

Statement 1. A packer assembly comprises a mandrel; a retainer movably disposed adjacent to the mandrel, the retainer comprising a ramp; a packer element disposed adjacent to the mandrel and the ramp; a ring movably disposed on the ramp, the ring comprising a spiral cut; and a sleeve disposed around the retainer and the ring, wherein the sleeve is deformable to retain at least the packer element or the ring.

Statement 2. The packer assembly of the statement 1, wherein the sleeve comprises petals.

Statement 3. The packer assembly of statement 1 or statement 2, wherein the sleeve further comprises overlapping petals.

Statement 4. The packer assembly of any preceding statement, wherein the sleeve comprises a continuous wall.

Statement 5. The packer assembly of any preceding statement, wherein the ring comprises a tapered portion.

Statement 6. The packer assembly of any preceding statement, wherein the sleeve comprises a base extending laterally from the mandrel.

Statement 7. The packer assembly of any preceding statement, wherein the base comprises an opening.

Statement 8. The packer assembly of any preceding statement, wherein the sleeve further comprises an elongated portion extending longitudinally from the base to cover the ring and the retainer.

Statement 9. A packer assembly comprising: a mandrel; retainers movably disposed adjacent to the mandrel, each retainer comprising a ramp; a packer element disposed adjacent to the mandrel and between the ramps of the retainers; a ring movably disposed on each ramp, each ring comprising a spiral cut; and sleeves disposed around the retainers and the rings, wherein the sleeves are deformable to retain at least the packer element or the rings.

Statement 10. The packer assembly of statement 9, wherein each sleeve comprises petals.

Statement 11. The packer assembly of statement 9 or statement 10, wherein each sleeve further comprises overlapping petals.

Statement 12. The packer assembly of any one of statements 9-11, wherein each sleeve comprises a continuous wall.

Statement 13. The packer assembly of any one of statements 9-12, wherein each ring comprises a tapered portion.

Statement 14. The packer assembly of any one of statements 9-13, wherein each sleeve comprises a base extending laterally from the mandrel.

Statement 15. The packer assembly of any one of statements 9-14, wherein each base comprises an opening.

Statement 16. The packer assembly of any one of statements 9-15, wherein each sleeve further comprises an elongated portion extending longitudinally from the base to cover the ring and the retainer.

Statement 17. A method for containing a packer element, the method comprising: setting a packer assembly in a wellbore, the packer assembly comprising: a mandrel; a retainer movably disposed adjacent to the mandrel, the retainer comprising a ramp; the packer element disposed adjacent to the mandrel and the ramp; a ring movably disposed on the ramp, the ring comprising a spiral cut; and a sleeve disposed around the retainer and the ring; deforming the sleeve with the ring; and retaining at least the packer element or the ring with the sleeve.

Statement 18. The method of the statement 17, further comprising deforming petals of the sleeve.

Statement 19. The method of the statement 17 or the statement 18, further comprising deforming overlapping petals of the sleeve.

Statement 20. The method of any one of the statements 17-19, further comprising deforming a continuous wall of the sleeve.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A packer assembly comprising:

a mandrel;

a retainer movably disposed adjacent to the mandrel, the retainer comprising a ramp;

a packer element disposed adjacent to the mandrel and the ramp;

a ring movably disposed on the ramp, the ring comprising a spiral cut and a tapered portion;

a sleeve disposed around the retainer and the ring, wherein the sleeve comprises an outer layer of metal petals that is in contact with an inner layer of metal petals, wherein the inner and outer layer of metal petals are configured to deform to retain at least the packer element or the ring;

a slot adjacent to each metal petal of the inner layer, wherein each slot includes a lateral portion that is perpendicular to a longitudinal portion, wherein the longitudinal portion is covered by a metal petal of the outer layer; and an empty space bound by the retainer, the sleeve, and the ring, the empty space configured to receive the tapered portion of the ring upon expansion of the packer element, wherein the ring and the sleeve are in direct physical contact with the packer element, the packer element configured to expand underneath a portion of the sleeve.

2. The packer assembly of claim 1, wherein the sleeve is configured to deform without breakage, to retain at least the packer element or the ring.

3. The packer assembly of claim 2, wherein the sleeve is made of steel, aluminum, brass, nickel, titanium, or combinations thereof.

4. The packer assembly of claim 1, wherein the lateral portion is shorter than the longitudinal portion.

5. The packer assembly of claim 1, wherein the sleeve is made of aluminum.

6. The packer assembly of claim 1, wherein the sleeve comprises a base extending laterally from the mandrel.

7. The packer assembly of claim 6, wherein the base comprises an opening.

8. The packer assembly of claim 7, wherein the sleeve further comprises an elongated portion extending longitudinally from the base to cover the ring and the retainer.

9. A packer assembly comprising:

a mandrel;

first and second retainers movably disposed adjacent to the mandrel, the first retainer comprising a first ramp, the second retainer comprising a second ramp;

a packer element disposed adjacent to the mandrel and between the first ramp and the second ramp;

a first ring movably disposed on the first ramp;

a second ring movably disposed on the second ramp, each ring comprising a spiral cut and a tapered portion;

a first sleeves disposed around the first retainers and the first ring;

a second sleeve disposed around the second retainer and the second ring, wherein each of the sleeves comprises an outer layer of metal petals that is in contact with an inner layer of metal petals, wherein the inner and outer layer of metal petals are configured to deform to retain at least the packer element or the respective first or second ring;

a slot adjacent to each metal petal of the inner layer, wherein each slot includes a lateral portion that is perpendicular to a longitudinal portion, wherein the longitudinal portion is covered by a metal petal of the outer layer; and empty spaces, wherein a first empty space is bound by the first retainer, the first sleeve, and the first ring, wherein a second empty space is bound by the second retainer, the second sleeve, and the second ring, each empty space configured to receive the tapered portion of the respective first or second ring upon expansion of the packer element, wherein the first ring and the first sleeve are in direct physical contact with the packer element, the packer element configured to expand underneath a portion of the first sleeve, wherein the second ring and the second sleeve are in direct physical contact with the packer element, the packer element further configured to expand underneath a portion of the second sleeve.

10. The packer assembly of claim 9, wherein each of the sleeves are configured to deform without breakage, to retain at least the packer element or the ring.

11. The packer assembly of claim 10, the first and second sleeves are made of steel, aluminum, brass, nickel, titanium, or combinations thereof.

12. The packer assembly of claim 9, wherein the lateral portion is shorter than the longitudinal portion.

13. The packer assembly of claim 9, wherein the first and second sleeves are made of aluminum.

14. The packer assembly of claim 9, wherein each sleeve comprises a base extending laterally from the mandrel.

15. The packer assembly of claim 14, wherein each base comprises an opening.

16. The packer assembly of claim 9, wherein each sleeve further comprises an elongated portion extending longitudinally from the base to cover the ring and the retainer.

17. A method for containing a packer element, the method comprising:

setting a packer assembly in a wellbore, the packer assembly comprising:

a mandrel;

a retainer movably disposed adjacent to the mandrel, the retainer comprising a ramp;

the packer element disposed adjacent to the mandrel and the ramp;

a ring movably disposed on the ramp, the ring comprising a spiral cut and a tapered portion;

a sleeve disposed around the retainer and the ring, the sleeve comprising an outer layer of metal petals that is in contact with an inner layer of metal petals;

an empty space bound by the retainer, the sleeve, and the ring, the empty space configured to receive the tapered portion of the ring upon expansion of the packer element, wherein the ring and the sleeve are in direct physical contact with the packer element, the packer element configured to expand underneath a portion of the sleeve; and a slot adjacent to each metal petal of the inner layer, wherein each slot includes a lateral portion that is perpendicular to a longitudinal portion, wherein the longitudinal portion is covered by a metal petal of the outer layer; deforming the sleeve with the ring; and retaining at least the packer element or the ring with the sleeve.

18. The method of claim 17, further comprising deforming the sleeve without breakage.

19. The method of claim 18, wherein the sleeve is made of steel, aluminum, brass, nickel, titanium, or combinations thereof.

20. The method of claim 17, wherein the lateral portion is shorter than the longitudinal portion.

* * * * *